US010472979B2

(12) United States Patent
Montgomery et al.

(10) Patent No.: US 10,472,979 B2
(45) Date of Patent: Nov. 12, 2019

(54) STATOR SHROUD WITH MECHANICAL RETENTION

(71) Applicant: United Technologies Corporation, Farmington, CT (US)

(72) Inventors: Dene A. Montgomery, Kennebunk, ME (US); Colin G. Amadon, Kennebunk, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 560 days.

(21) Appl. No.: 15/239,921

(22) Filed: Aug. 18, 2016

(65) Prior Publication Data

US 2018/0051579 A1 Feb. 22, 2018

(51) Int. Cl.

| | |
|---|---|
| ***F01D 9/04*** | (2006.01) |
| ***F01D 25/06*** | (2006.01) |
| ***F01D 25/24*** | (2006.01) |

(52) U.S. Cl.

CPC ..... *F01D 9/042* (2013.01); *F01D 25/06* (2013.01); *F01D 25/24* (2013.01); *F05D 2220/32* (2013.01); *F05D 2240/12* (2013.01); *F05D 2240/80* (2013.01); *F05D 2260/96* (2013.01); *F05D 2300/431* (2013.01); *F05D 2300/501* (2013.01)

(58) Field of Classification Search

CPC ..... F01D 25/06; F01D 25/24; F01D 5/3023; F01D 9/042; F04D 29/668; F05D 2220/32; F05D 2240/12; F05D 2240/80; F05D 2260/30; F05D 2260/96; F05D 2300/43; F05D 2300/431; F05D 2300/501

See application file for complete search history.

(56) References Cited

U.S. PATENT DOCUMENTS

| | | | | |
|---|---|---|---|---|
| 3,867,066 A | | 2/1975 | Canova et al. | |
| 4,655,682 A | * | 4/1987 | Kunz | F01D 9/042 415/119 |
| 4,832,568 A | | 5/1989 | Roth et al. | |
| 5,074,752 A | | 12/1991 | Murphy et al. | |
| 5,399,069 A | * | 3/1995 | Marey | F01D 9/042 415/189 |
| 5,494,404 A | | 2/1996 | Furseth et al. | |
| 5,765,993 A | | 6/1998 | Weiss | |

(Continued)

FOREIGN PATENT DOCUMENTS

| | | |
|---|---|---|
| EP | 0219445 A1 | 4/1987 |
| EP | 0811753 A1 | 12/1997 |

(Continued)

*Primary Examiner* — Jesse S Bogue

(74) *Attorney, Agent, or Firm* — Cantor Colburn LLP

(57) ABSTRACT

A stator assembly for a gas turbine engine includes an arcuate shroud including a shroud pocket, the shroud pocket having a shroud slot extending therethrough. A stator vane is insertable into the shroud pocket and includes a vane slot extending therethrough. A strap extends through the shroud slot and the vane slot to retain the vane to the shroud. A gas turbine engine includes a combustor and a stator and case assembly in in fluid communication with the combustor. The stator and case assembly includes a case defining a working fluid flowpath for the gas turbine engine and a stator assembly secured at the case.

15 Claims, 5 Drawing Sheets

(56) References Cited

U.S. PATENT DOCUMENTS

| | | | | |
|---|---|---|---|---|
| 6,595,747 | B2 * | 7/2003 | Bos | F01D 9/042 415/209.2 |
| 6,619,917 | B2 * | 9/2003 | Glover | F01D 9/042 29/889.22 |
| 7,984,548 | B2 * | 7/2011 | Anderson | F01D 5/22 29/401.1 |
| 8,500,394 | B2 * | 8/2013 | Major | F01D 17/162 415/160 |
| 8,544,173 | B2 * | 10/2013 | Miller | B23P 6/005 29/889.1 |
| 8,764,392 | B2 * | 7/2014 | Penalver Castro | F01D 9/042 415/189 |
| 9,951,639 | B2 * | 4/2018 | Ivakitch | F01D 9/042 |
| 2007/0098557 | A1 * | 5/2007 | Barnett | F01D 9/042 416/193 A |
| 2014/0356158 | A1 * | 12/2014 | Barnett | F01D 9/042 415/209.3 |

FOREIGN PATENT DOCUMENTS

| | | | | |
|---|---|---|---|---|
| EP | 1079075 | A2 | 2/2001 | |
| EP | 1213484 | A1 | 6/2002 | |
| EP | 1219785 | A1 | 7/2002 | |
| EP | 1741878 | A2 | 1/2007 | |
| EP | 2204539 | A2 | 7/2010 | |
| EP | 2479383 | A2 | 7/2012 | |
| EP | 2620591 | A2 | 7/2013 | |
| GB | 599391 | A * | 3/1948 | F01D 5/3023 |
| GB | 865544 | A | 4/1961 | |
| GB | 2272027 | A | 5/1994 | |

* cited by examiner

STATOR SHROUD WITH MECHANICAL RETENTION

BACKGROUND

This disclosure relates to gas turbine engines, and more particularly to stator vane arrangements for gas turbine engines.

A gas turbine engine typically includes a rotor assembly which extends axially through the engine. A stator assembly is radially spaced from the rotor assembly and includes an engine case which circumscribes the rotor assembly. A flow path for working medium gasses is defined within the case and extends generally axially between the stator assembly and the rotor assembly.

The rotor assembly includes an array of rotor blades extending radially outwardly across the working medium flowpath into proximity with the case. Arrays of stator vane assemblies are alternatingly arranged between rows of rotor blades and extend inwardly from the case across the working medium flowpath into proximity with the rotor assembly to guide the working medium gases when discharged from the rotor blades. Some stator vane assemblies, such as those located between adjacent low pressure compressor or fan rotors, include an outer shroud fixed to a casing and a plurality of stator vanes along with an inner shroud cantilevered off of the outer shroud.

The stator vanes are rigidly fixed to the inner shroud and outer shroud and are thus configured with aeromechanical tuning of vibratory modes, which often results in the vane deviating from an optimal aerodynamic shape.

SUMMARY

In one embodiment, a stator assembly for a gas turbine engine includes an arcuate shroud including a shroud pocket, the shroud pocket having a shroud slot extending therethrough. A stator vane is insertable into the shroud pocket and includes a vane slot extending therethrough. A strap extends through the shroud slot and the vane slot to retain the vane to the shroud.

Additionally or alternatively, in this or other embodiments a volume of potting is located at the shroud pocket to retain the stator vane thereat.

Additionally or alternatively, in this or other embodiments the potting is a rubber material.

Additionally or alternatively, in this or other embodiments the potting includes a grommet located at the shroud pocket.

Additionally or alternatively, in this or other embodiments the shroud pocket includes a pocket sidewall and a pocket base.

Additionally or alternatively, in this or other embodiments the shroud slot extends through the pocket sidewall.

Additionally or alternatively, in this or other embodiments the stator vane is inserted in two shroud pockets of two shrouds, with a strap extending through a vane slot and a pocket slot at each shroud of the two shrouds.

In another embodiment, a stator and case assembly for a gas turbine engine includes a case defining a working fluid flowpath for the gas turbine engine, and a stator assembly secured at the case. The stator assembly includes a plurality of stator segments arranged circumferentially about an engine axis. Each stator segment includes an arcuate shroud including a shroud pocket, the shroud pocket having a shroud slot extending therethrough, a stator vane insertable into the shroud pocket and including a vane slot extending therethrough, and a strap extending through the shroud slot and the vane slot to retain the vane to the shroud.

Additionally or alternatively, in this or other embodiments a volume of potting is located at the shroud pocket to retain the stator vane thereat.

Additionally or alternatively, in this or other embodiments the potting is a rubber material.

Additionally or alternatively, in this or other embodiments the potting includes a grommet located at the shroud pocket.

Additionally or alternatively, in this or other embodiments the shroud pocket includes a pocket sidewall and a pocket base.

Additionally or alternatively, in this or other embodiments the shroud slot extends through the pocket sidewall.

Additionally or alternatively, in this or other embodiments the stator vane is inserted in two shroud pockets of two shrouds, with a strap extending through a vane slot and a pocket slot at each shroud of the two shrouds.

In yet another embodiment, a gas turbine engine includes a combustor and a stator and case assembly in in fluid communication with the combustor. The stator and case assembly includes a case defining a working fluid flowpath for the gas turbine engine and a stator assembly secured at the case. The stator assembly includes a plurality of stator segments arranged circumferentially about an engine axis, each stator segment including an arcuate shroud including a shroud pocket, the shroud pocket having a shroud slot extending therethrough, a stator vane insertable into the shroud pocket and including a vane slot extending therethrough and a strap extending through the shroud slot and the vane slot to retain the vane to the shroud.

Additionally or alternatively, in this or other embodiments a volume of potting is located at the shroud pocket to retain the stator vane thereat.

Additionally or alternatively, in this or other embodiments the potting is a rubber material.

Additionally or alternatively, in this or other embodiments the potting includes a grommet located at the shroud pocket.

Additionally or alternatively, in this or other embodiments the shroud pocket includes a pocket sidewall and a pocket base, the shroud slot extending through the pocket sidewall.

Additionally or alternatively, in this or other embodiments the stator vane is inserted in two shroud pockets of two shrouds, with a strap extending through a vane slot and a pocket slot at each shroud of the two shrouds.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
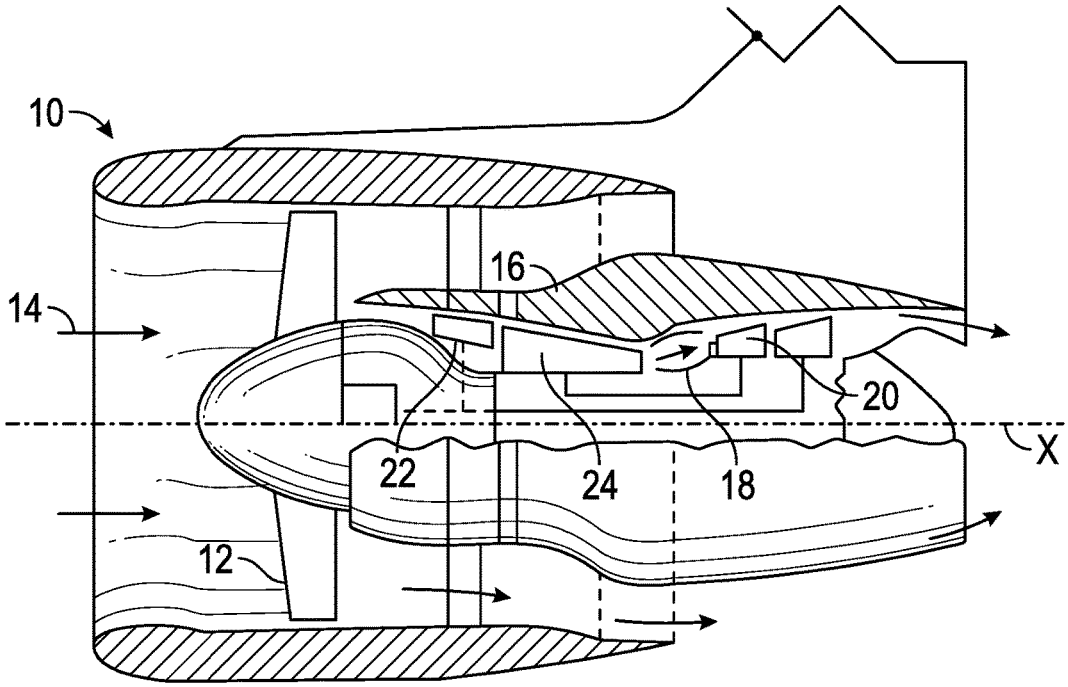
FIG. 1 is a schematic illustration of a gas turbine engine.

FIG. 1 is a schematic illustration of a gas turbine engine 10. The gas turbine engine generally has a fan 12 through which ambient air is propelled in the direction of arrow 14, a compressor 16 for pressurizing the air received from the fan 12 and a combustor 18 wherein the compressed air is mixed with fuel and ignited for generating combustion gases.

The gas turbine engine 10 further comprises a turbine section 20 for extracting energy from the combustion gases. Fuel is injected into the combustor 18 of the gas turbine engine 10 for mixing with the compressed air from the compressor 16 and ignition of the resultant mixture. The fan 12, compressor 16, combustor 18, and turbine 20 are typically all concentric about a common central longitudinal axis of the gas turbine engine 10.

The gas turbine engine 10 may further comprise a low pressure compressor 22 located upstream of a high pressure compressor 24 and a high pressure turbine located upstream of a low pressure turbine. For example, the compressor 16 may be a multi-stage compressor 16 that has a low-pressure compressor 22 and a high-pressure compressor 24 and the turbine 20 may be a multistage turbine 20 that has a high-pressure turbine and a low-pressure turbine. In one embodiment, the low-pressure compressor 22 is connected to the low-pressure turbine and the high pressure compressor 24 is connected to the high-pressure turbine.

Figure 2:
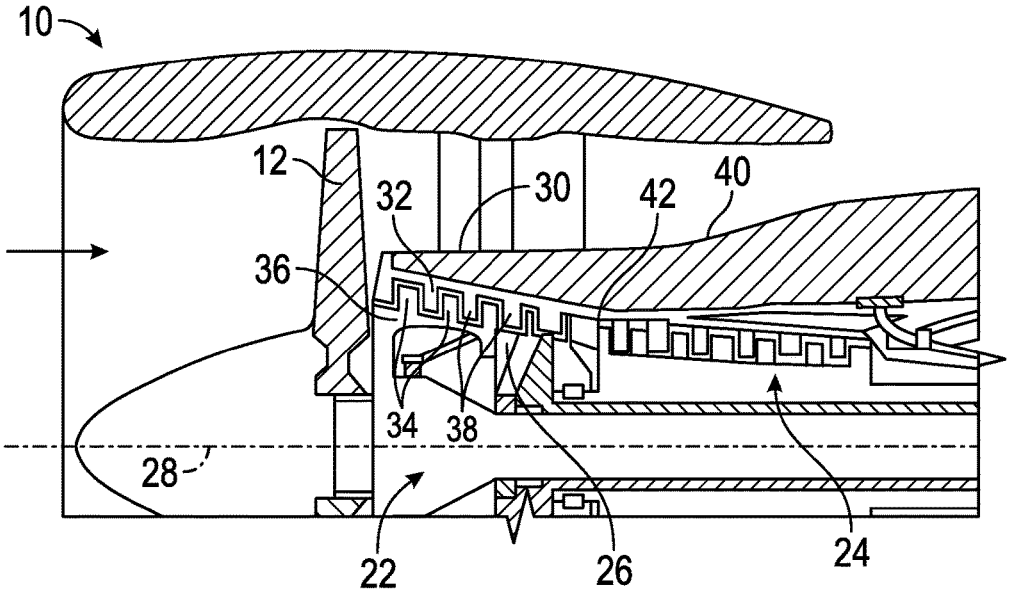
FIG. 2 is a schematic illustration of a low pressure compressor section of a gas turbine engine.

Referring now to FIG. 2, the low pressure compressor (LPC) 22 includes an LPC case 30 with one or more LPC rotors 26 located in the LPC case 30 and rotatable about an engine axis 28. One or more LPC stators 32 are located axially between successive LPC rotors 26. Each LPC rotor 26 includes a plurality of rotor blades 34 extending radially outwardly from a rotor disc 36, while each LPC stator 32 includes a plurality of stator vanes 38 extending radially inwardly from the LPC case 30. The LPC 22 further includes an intermediate case 40 located axially downstream from the LPC case 30 and is utilized to direct airflow 14 from the LPC 22 to the high pressure compressor 24. An exit stator 42 is located in the intermediate case 40.

Figure 3:
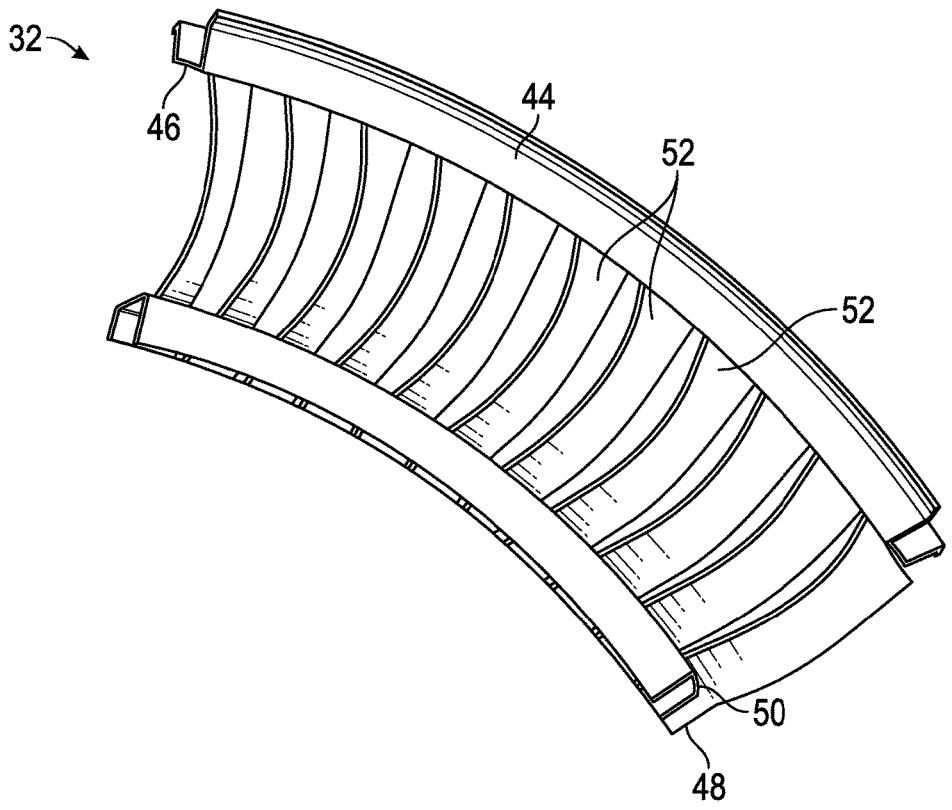
FIG. 3 is a perspective view of an embodiment of a stator assembly of a gas turbine engine.

While the following description is in the context of an LPC stator 32, one skilled in the art will readily appreciated that the present disclosure may be readily applied to other stator assemblies including those configured as segmented stators and those configured as full ring stators. Referring now to FIG. 3, the LPC stator 32 is a segmented stator, with each LPC stator 32 extending partially circumferentially about the engine axis 28. For example, in some embodiments 6, 8, 10 or 12 LPC stators 32 may be placed circumferentially adjacently to complete an LPC stator assembly about the engine axis 28. Each LPC stator 32 includes an outer shroud 44 fixed to the LPC case 30 and defining an outer flowpath surface 46. The LPC stator 32 similarly includes an inner shroud 48 radially spaced from the outer shroud 44 and defining an inner flowpath surface 50. In some embodiments, the outer shroud 44 and the inner shroud 48 are formed from metallic materials, for example, an aluminum material or alternatively a composite material such as a thermoplastic polyetherimide material or a plastic material. A plurality of stator vanes 52 extend between the outer shroud 44 and the inner shroud 48. In some embodiments, the stator vanes 52 are formed from, for example, a metal material or from a composite material such as an epoxy resin impregnated carbon material.

Figure 4:
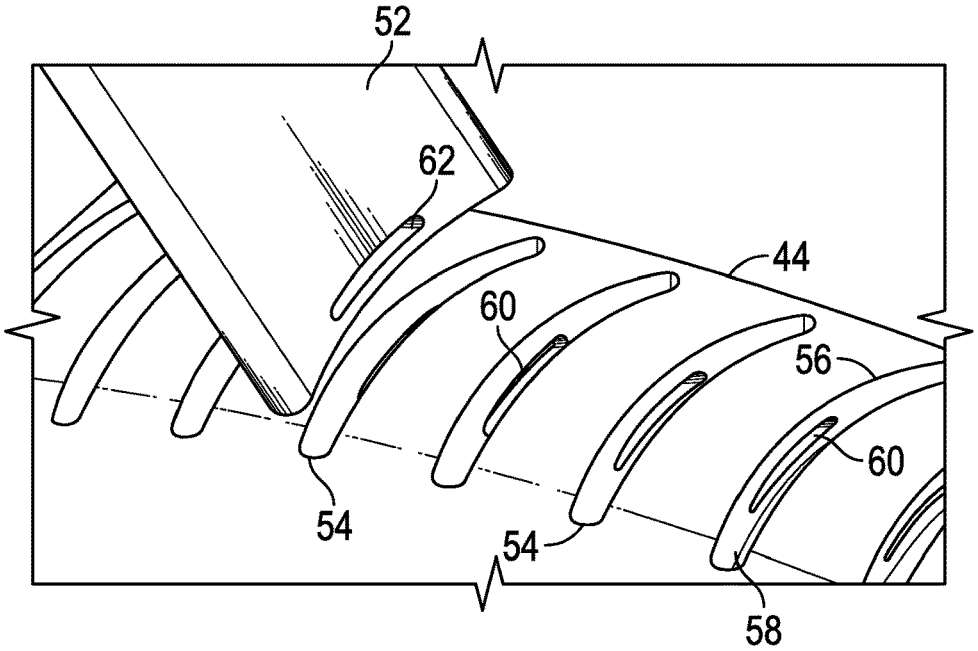
FIG. 4 is a perspective view of an embodiment of a stator assembly.
Figure 5:
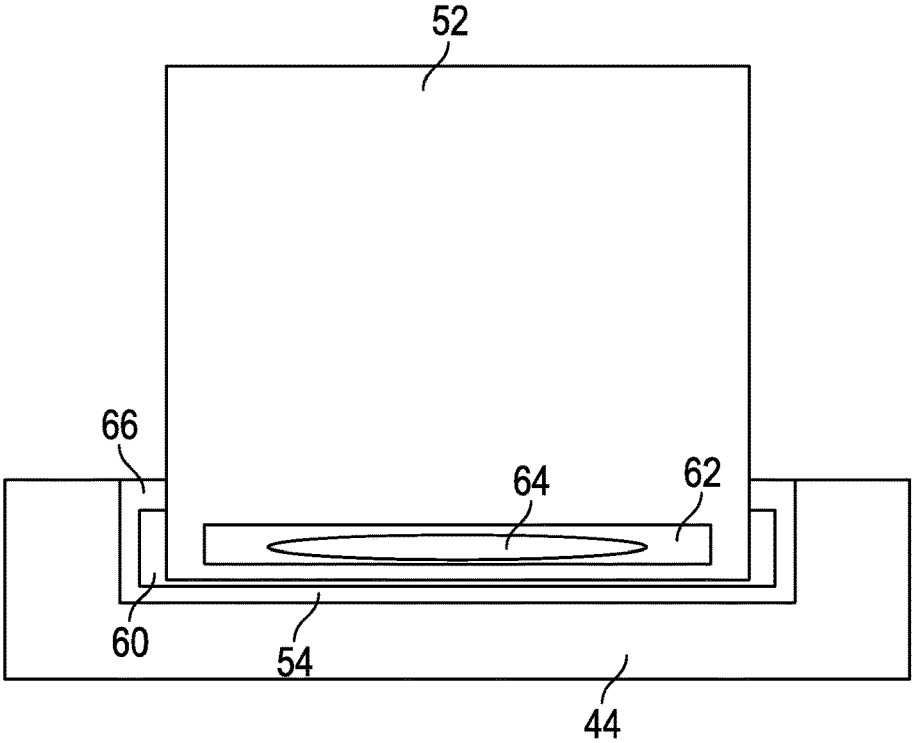
FIG. 5 is a cross-sectional view of an embodiment of a stator assembly.

Referring now to FIG. 4, the outer shroud 44 includes a plurality of outer shroud pockets 54 spaced circumferentially along the outer shroud 44. Each outer shroud pocket 54 is sized and configured to receive a stator vane 52 and includes an outer shroud pocket sidewall 56 and an outer shroud pocket base 58, which defines a depth to which the stator vane 52 may be inserted into the outer shroud pocket 54. The outer shroud pocket 54 includes a plurality of outer shroud slots 60 through the outer shroud pocket sidewalls 56 of the outer shroud 44. Further, the stator vanes 52 include corresponding outer vane slots 62 extending therethrough. Referring now to the cross-sectional view of FIG. 5, an outer strap 64 is installed through the outer shroud slots 60 and the outer vane slots 62. Once the outer strap 64 is installed, a volume of potting material 66 is installed at the outer shroud 44, and more specifically at the outer shroud pockets 54 as a primary retention to secure the stator vanes 52 at the outer shroud 44, while the outer strap 64 acts as a secondary retention in case of failure of the potting material 66. In some embodiments, the potting material 66 is a rubber or other elastomeric material. The potting material 66 at least partially fills the outer shroud pocket 54.

Figure 6:
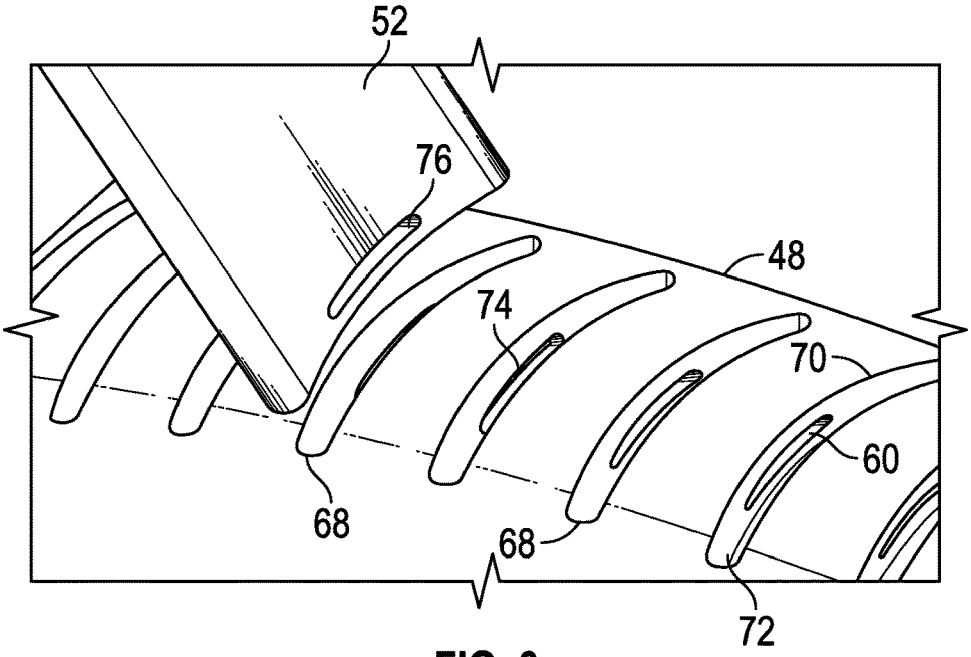
FIG. 6 is a perspective view of an embodiment of a stator assembly.
Figure 7:
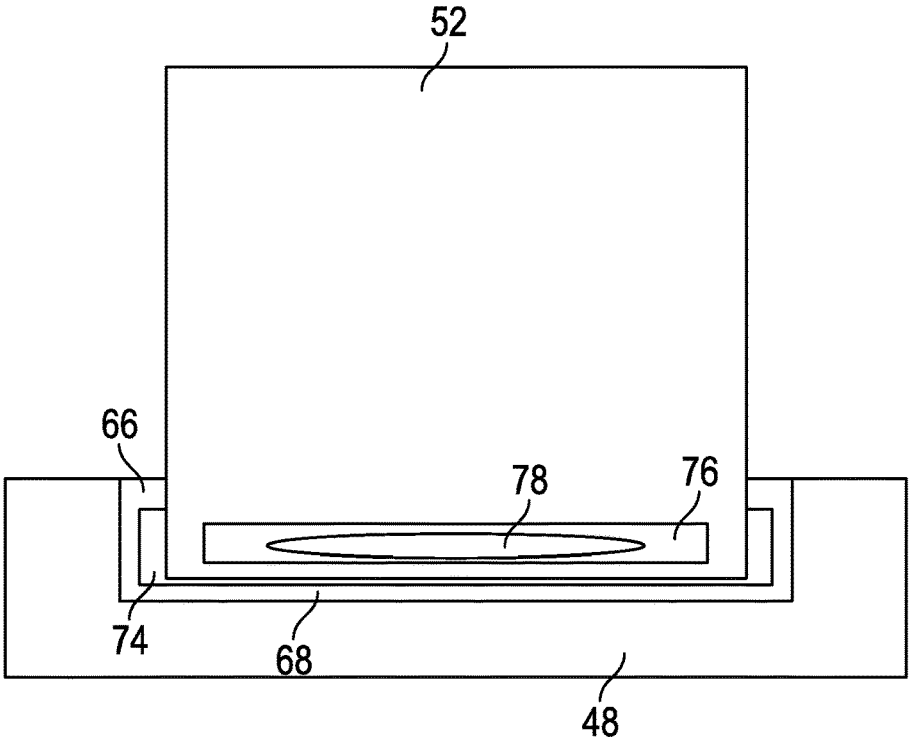
FIG. 7 is a cross-sectional view of an embodiment of a stator assembly.

In addition to or as an alternative to the arrangement described above with reference to FIGS. 4 and 5, a similar arrangement may be present at the inner shroud 48, as illustrated in FIG. 6 and FIG. 7 and described below. Referring now to FIG. 6, the inner shroud 48 includes a plurality of inner shroud pockets 68 spaced circumferentially along the inner shroud 48. Each inner shroud pocket 68 is sized and configured to receive a stator vane 52 and includes an inner shroud pocket sidewall 70 and an inner shroud pocket base 72, which defines a depth to which the stator vane 52 may be inserted into the inner shroud pocket 68. The inner shroud pocket 68 includes a plurality of inner shroud slots 74 through the inner shroud pocket sidewalls 70 of the inner shroud 48. Further, the stator vanes 52 include corresponding inner vane slots 76 extending therethrough. Referring now to the cross-sectional view of FIG. 7, an inner strap 78 is installed through the inner shroud slots 74 and the inner vane slots 76. Once the inner strap 78 is installed, a volume of potting material 66 is installed at the inner shroud 48, and more specifically at the inner shroud pockets 68 as a primary retention to secure the stator vanes 52 at the inner shroud 48, while the inner strap 78 acts as a secondary retention in case of failure of the potting material 66.

Figure 8:
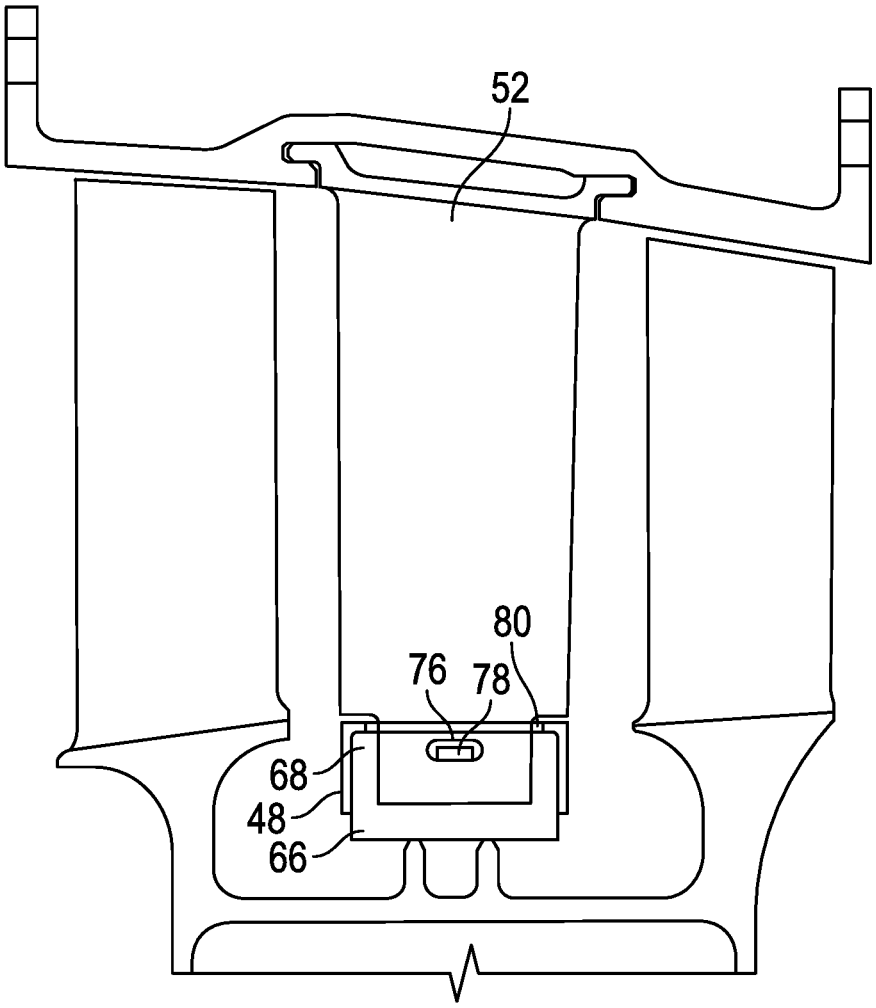
FIG. 8 is a cross-sectional view of another embodiment of a stator assembly.

Referring now to FIG. 8, in some embodiments, the inner shroud 48 is configured as a C-channel shroud, the inner shroud 48 having a C-channel cross-sectional shape, defining the inner shroud pocket 68. The inner shroud 48 includes inner shroud openings 80 through which the stator vanes 52 extend. The inner strap 78 extends through the inner shroud pocket 68 and through inner vane slots 76 of the stator vanes 52 to retain the inner shroud 48 at the stator vanes 52. Potting material 66 is then utilized to at least partially fill the inner shroud pocket 68.

Utilizing potting material as primary retention of the stator vanes at the outer shroud and the inner shroud allows the stator vanes to be formed from a different material than the outer shroud and/or the inner shroud. For example, the stator vanes may be formed from a composite material while the inner and outer shrouds are formed from a metal material resulting in a considerable weight reduction when compared to an all-metal stator assembly. Further, the potting material provides necessary vibrational damping properties allowing the stator assembly in general and the stator vanes in particular to be formed to an aerodynamically optimized shape. The outer and inner straps, respectively, provide secondary retention of the stator vanes at the shrouds.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A stator assembly for a gas turbine engine, comprising:
an arcuate shroud including a shroud pocket formed in a surface wall of the shroud and extending from a flowpath surface of the shroud, the shroud pocket including:
a shroud pocket base defining a depth of the shroud pocket; and
a shroud pocket sidewall extending from the shroud pocket base to the flowpath surface, the shroud pocket sidewall having a shroud slot extending therethrough;
a stator vane insertable into the shroud pocket and including a vane slot extending therethrough, the shroud pocket base defining a depth to which the stator vane may be inserted into the shroud pocket; and
a strap extending through the shroud slot and the vane slot to retain the vane to the shroud.

2. The stator assembly of claim 1 further comprising a volume of potting disposed at the shroud pocket to retain the stator vane thereat.

3. The stator assembly of claim 2, wherein the potting is a rubber material.

4. The stator assembly of claim 2, wherein the potting comprises a grommet disposed at the shroud pocket.

5. The stator assembly of claim 1, wherein the stator vane is inserted in two shroud pockets of two shrouds, with a strap extending through the vane slot and the shroud slot at each shroud of the two shrouds.

6. A stator and case assembly for a gas turbine engine comprising:
a case defining a working fluid flowpath for the gas turbine engine; and
a stator assembly secured at the case, the stator assembly including a plurality of stator segments arranged circumferentially about an engine axis, each stator segment including:
an arcuate shroud including a shroud pocket formed in a surface wall of the shroud and extending from a flowpath surface of the shroud, the shroud pocket including:
a shroud pocket base defining a depth of the shroud pocket; and
a shroud pocket sidewall extending from the shroud pocket base to the flowpath surface, the shroud pocket sidewall having a shroud slot extending therethrough;
a stator vane insertable into the shroud pocket and including a vane slot extending therethrough, the shroud pocket base defining a depth to which the stator vane may be inserted into the shroud pocket; and
a strap extending through the shroud slot and the vane slot to retain the vane to the shroud.

7. The stator and case assembly of claim 6, further comprising a volume of potting disposed at the shroud pocket to retain the stator vane thereat.

8. The stator and case assembly of claim 7, wherein the potting is a rubber material.

9. The stator and case assembly of claim 7, wherein the potting comprises a grommet disposed at the shroud pocket.

10. The stator and case assembly of claim 6, wherein the stator vane is inserted in two shroud pockets of two shrouds, with a strap extending through the vane slot and the shroud slot at each shroud of the two shrouds.

11. A gas turbine engine, comprising:
a combustor; and
a stator and case assembly in in fluid communication with the combustor, the stator and case assembly including:
a case defining a working fluid flowpath for the gas turbine engine; and
a stator assembly secured at the case, the stator assembly including a plurality of stator segments arranged circumferentially about an engine axis, each stator segment including:
an arcuate shroud including a shroud pocket formed in a surface wall of the shroud and extending from a flowpath surface of the shroud, the shroud pocket including:
a shroud pocket base defining a depth of the shroud pocket; and
a shroud pocket sidewall extending from the shroud pocket base to the flowpath surface, the shroud pocket sidewall having a shroud slot extending therethrough;
a stator vane insertable into the shroud pocket and including a vane slot extending therethrough, the shroud pocket base defining a depth to which the stator vane may be inserted into the shroud pocket; and
a strap extending through the shroud slot and the vane slot to retain the vane to the shroud.

12. The gas turbine engine of claim 11, further comprising a volume of potting disposed at the shroud pocket to retain the stator vane thereat.

13. The gas turbine engine of claim 12, wherein the potting is a rubber material.

14. The gas turbine engine of claim 12, wherein the potting comprises a grommet disposed at the shroud pocket.

15. The gas turbine engine of claim 11, wherein the stator vane is inserted in two shroud pockets of two shrouds, with a strap extending through the vane slot and the shroud slot at each shroud of the two shrouds.

* * * * *